United States Patent [19]

Falack

[11] Patent Number: 4,912,780

[45] Date of Patent: Apr. 3, 1990

[54] COMBINED SHIRT AND RELIGIOUS GARMENT

[76] Inventor: Jack Falack, 510 Quentin Rd., Brooklyn, N.Y. 11223

[21] Appl. No.: 278,550

[22] Filed: Nov. 17, 1988

[51] Int. Cl.[4] ..... A41D 1/04

[52] U.S. Cl. ..... 2/102; 2/103; 2/92

[58] Field of Search ..... 2/48, 49 R, 49 A, 51, 2/52, 83, 92, 102, 107, 113, 114, 44, 244, 88, 90, 103

[56] References Cited

U.S. PATENT DOCUMENTS

| | | | |
|---|---|---|---|
| 1,263,533 | 8/1918 | Greene | 2/92 |
| 1,288,408 | 12/1918 | Hait et al. | 2/92 X |
| 1,390,033 | 9/1921 | Henderson | 2/92 |
| 3,047,875 | 8/1962 | Patterson, Jr. | 2/52 X |
| 3,276,432 | 10/1966 | Murcott | 2/49 R |
| 4,602,385 | 7/1986 | Warren | 2/92 X |

FOREIGN PATENT DOCUMENTS

| | | | |
|---|---|---|---|
| 1044518 | 11/1953 | France | 2/92 |

*Primary Examiner*—Werner H. Schroeder
*Assistant Examiner*—Jeanette E. Chapman
*Attorney, Agent, or Firm*—Ezra Sutton

[57] ABSTRACT

A combined shirt and religious article that is rectangular in shape, includes a neck opening, and fasteners for fitting it to the torso of the wearer. It replaces the need for a separate undershirt and fringed religious garment.

7 Claims, 1 Drawing Sheet

COMBINED SHIRT AND RELIGIOUS GARMENT

FIELD OF THE INVENTION

The present invention relates to a religious article which also serves as a shirt or garment to be worn about one's torso.

BACKGROUND OF THE INVENTION

FIG. 1 illustrates a known religious article, which may be referred to as a garment with fringes on its four corners. It is worn by members of the Jewish religion by draping it over one's shoulders. The article 10 in FIG. 1 includes a central opening 12 so it can be placed over one's head and worn on the body. It includes 4 corners 14 each having a hole 16 through which fringes 18 pass so they can be tied to the corners of the article.

This religious article has a number of physical drawbacks. Most importantly, it moves around on the body causing discomfort to the wearer. Further, since it is loose fitting, it does not provide a neat appearance.

Accordingly, it is an object of the present invention to provide a religious article which also serves as a shirt, is comfortable to wear, is neat in appearance, fits well, takes the place of an undershirt, and is less likely to move around on the body.

SUMMARY OF THE INVENTION

In accordance with the principles of the present invention, there is provided a combined shirt and religious article which is substantially rectangular in shape, has four corners with fringes, a neck opening similar to that of a shirt, and fasteners for fastening the edges of the article to each other so that it fits on the body.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT

Figure 1:
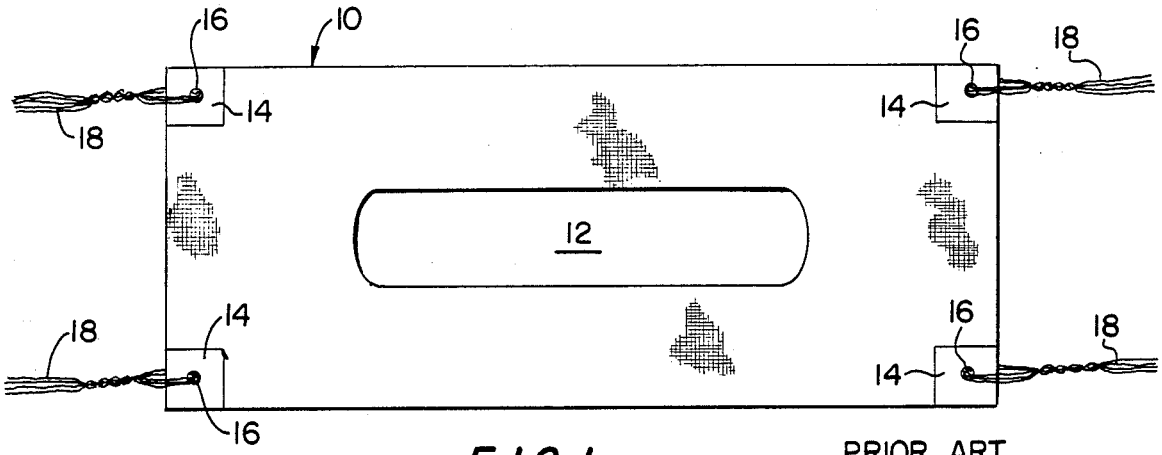
FIG. 1 PRIOR ART
FIG. 1 is a plan view of a prior art religious article.
Figure 2:
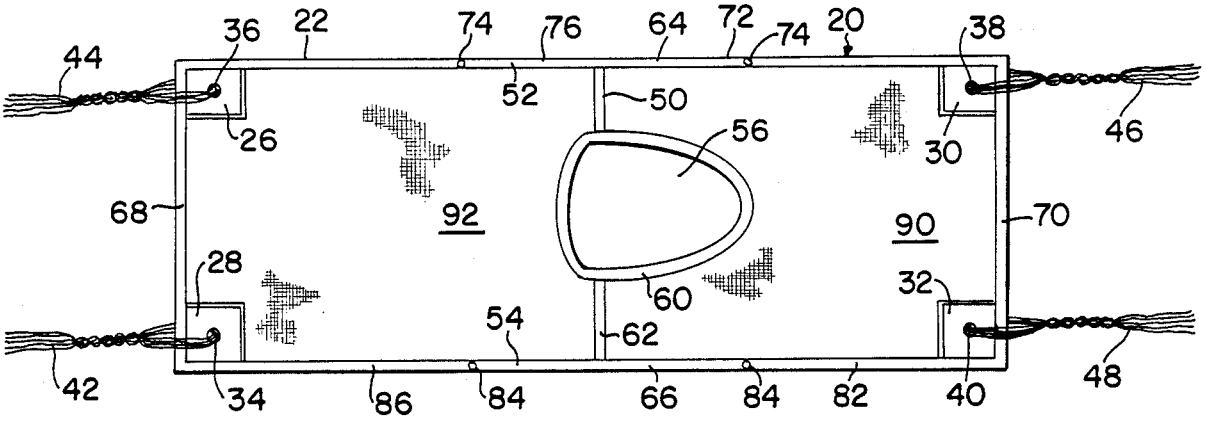
FIG. 2 is a plan view of the combined shirt and religious article of the present invention.
Figure 3:
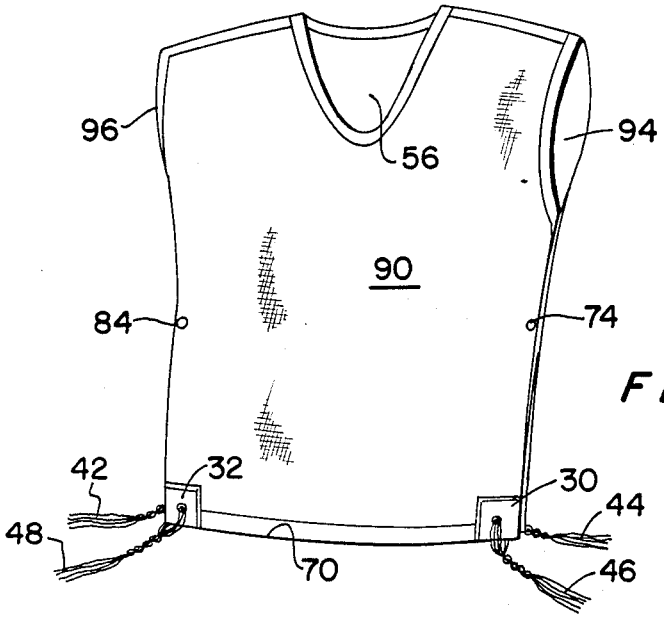
FIG. 3 is a perspective view of the invention as it appears when worn on one's torso.

The combined shirt and religious article of the present invention is designated by the reference numeral 20. It includes a substantially rectangular-shaped garment 22 having four corner sections 26, 28, 30, and 32. Each corner section is reinforced, as in the prior art, with two layers of fabric. Holes 34, 36, 38, and 40 are formed in the respective corner sections to which religious fringes 42, 44, 46, and 48 are tied. The garment may be formed of wool or cotton so that it is more comfortable to the wearer.

Article 20 includes a lateral axis 50 and longitudinal edges 52 and 54. A neck opening 56 is formed in article 20 substantially to one side of lateral axis 50, so the neck and head of the wearer can pass through the neck opening 56 and to provide an appearance similar to a shirt or undershirt.

Stripping or binding 60 is sewn to the article around the neck opening 56, stripping 62 is sewn along the lateral axis 50, stripping 64 and 66 is sewn along the longitudinal edges 52 and 54, and stripping 68 and 70 is sewn along the side edges of the article. Alternatively, instead of stripping or binding along the longitudinal and side edges, seamed edges may be formed, or the edges may be folded over and sewn to provide finished garment edges. Also, instead of using stripping 62 for the lateral axis, the front and back panels 90 and 92 of the garment may be seamed or sewn to each other.

Longitudinal edge 52 includes a front section 72 having a snap fastener 74 attached to it, and a back section 76 having the cooperating portion of snap fastener 74 attached. Longitudinal edge 54 includes a front section 82 having a snap fastener 84 attached to it, and a back section 86 having the cooperating portion of snap fastener 84 attached. In this manner, when snap fasteners 74 and 84 are fastened, the front panel 90 is fastened to the back panel 92 to form arm holes 94 and 96.

In accordance with the present invention, any other type of fastener may be employed instead of snap fasteners 74 and 84. For example, buttons, hook and loop fasteners, VELCRO TM and the like may be employed instead.

As a result, when the garment is worn, it is well fitting and comfortable, does not shift around as much as the article in FIG. 1, and takes the place of an undershirt.

The article is manufactured by cutting openings in front and back panels 90, 92, so that when sewn together, they form neck opening 56. The front panel 90 is then sewn to the back panel 92 along lateral axis 50 using stripping 62. Then stripping 60 is sewn around neck opening 56 to reinforce it. Also stripping 64 and 66 is sewn along the longitudinal edges and along the side edges 68 and 70 to finish the garment edges. Then the fringes are attached to each of the four corners. Also, fasteners 74 and 84 are attached to the longitudinal edges to complete the garment.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A combined shirt and religious garment, comprising:

substantially rectangular-shaped garment having four corners;

a lateral axis in said garment defining a front panel and a back panel;

an opening formed in said garment substantially to one side of said lateral axis to form a passageway for the neck and head of the wearer in said front panel;

each of said four corners having a reinforcing layer of fabric and a hole formed therein;

a tassle of religious fringes tied to each of said corners through the hole formed in each corner;

said garment having two longitudinal edges, with each longitudinal edge having a front section and a back section; and means for fastening the front and back sections of each longitudinal edge to form a pair of arm holes in said garment and to fit it to the torso of the wearer.

2. A combined shirt and religious garment in accordance with claim 1 wherein said garment is made of wool.

3. A combined shirt and religious garment in accordance with claim 1 wherein said garment is made of cotton.

4. A combined shirt and religious garment in accordance with claim 1 wherein said fastening means are snap fasteners and are mounted on said longitudinal edges.

5. A combined shirt and religious garment in accordance with claim 1 wherein said fastening means are hook and loop fasteners.

6. A combined shirt and religious garment in accordance with claim 1 wherein said fastening means are buttons.

7. A combined shirt and religious garment in accordance with claim 1 wherein said neck opening is substantially in the shape of a V.

* * * * *